US006968848B2

(12) United States Patent
Grant et al.

(10) Patent No.: US 6,968,848 B2
(45) Date of Patent: Nov. 29, 2005

(54) RETRACTABLE BRISTLE BRUSH

(76) Inventors: George L. Grant, 15003 St. Cloud Dr., Houston, TX (US) 77062; Leopold M. Grant, 110 Bluefish Cir., Jupiter, FL (US) 33477

( * ) Notice: Subject to any disclaimer, the term of this patent is extended or adjusted under 35 U.S.C. 154(b) by 314 days.

(21) Appl. No.: 10/318,696

(22) Filed: Dec. 13, 2002

(65) Prior Publication Data

US 2004/0112398 A1 Jun. 17, 2004

(51) Int. Cl.[7] ..... A45D 24/10; A45D 24/16
(52) U.S. Cl. ..... 132/123; 132/121; 132/119
(58) Field of Search ..... 132/119–123, 147, 132/228, 237–240, 272; 15/169, 184, 203

(56) References Cited

U.S. PATENT DOCUMENTS

| | | | | |
|---|---|---|---|---|
| 4,028,768 | A * | 6/1977 | Pascal | 15/203 |
| 4,226,251 | A | 10/1980 | Wall | |
| 4,567,905 | A | 2/1986 | Stewart et al. | |
| 4,596,261 | A | 6/1986 | Renda et al. | |
| 4,971,081 | A * | 11/1990 | Seja et al. | 132/121 |
| 5,815,877 | A | 10/1998 | Heneveld | |
| 6,070,594 | A | 6/2000 | Mears | |
| 6,631,831 | B1 * | 10/2003 | Loiselle | 15/169 |

OTHER PUBLICATIONS

Magazine Advertisement, EpiBrush, 1989.

* cited by examiner

*Primary Examiner*—Kevin Shaver
*Assistant Examiner*—Stephanie L. Willatt
(74) *Attorney, Agent, or Firm*—Winstead Sechrest & Minick; Henry L. Ehrlich

(57) ABSTRACT

A retractable bristle brush of the type for retracting the bristles into the brush is provided. The retractable bristle brush includes a handle adapted for grasping by a user and an elongated, cylindrical inner mandrel extending from the handle; a plurality of bristles extending outwardly from the inner mandrel; a cylindrical external mandrel is slidably mounted on the inner mandrel, the external mandrel forming a bristle orifice through a top surface thereof in connection with a bristle cavity formed by the external mandrel wherein each associated orifice and bristle cavity disposes at least one bristle; and a mechanism for controlling bristle extension in connection between the external mandrel and the internal mandrel limiting longitudinal movement of the external mandrel between an open position wherein the bristles extend through the orifice and a closed position wherein the bristles are retracted to a position within the bristle cavity proximate the top surface of the external mandrel.

16 Claims, 3 Drawing Sheets

RETRACTABLE BRISTLE BRUSH

TECHNICAL FIELD

The present invention relates in general to brushes and in particular to a brush for grooming hair wherein the bristles may be retracted into the brush for ease of removal of the brush from hair when desired.

BACKGROUND

Throughout history brushes of various materials of construction and shapes have been utilized for grooming and treating various hair or fiber types. These brushes, while often marketed for specific applications, are equally applicable for uses in grooming human or animal hair and natural and synthetic fibers. The primary purpose of brushes is to remove debris from hair and/or fibers and to separate the strands. Brushes are also very often utilized to curl or shape hair and/or fibers in particular by wrapping strands about a brush and applying a medium such as heat and/or other compound to maintain the strands in a formed position. For brevity and illustration this specification addresses the utilization of brushes for hair grooming and treatment.

Conventional brushes have a main body divided into a handle and bristle section. The bristle section has a plurality of bristles extending outwardly therefrom. These brushes are designed with varying materials of construction and alignment and density of bristles for grooming various textures and thickness of hairs. One drawback of these conventional brushes is their limited ability to be utilized for effective self-styling of hair and removal from hair without losing the form of the hair. Another drawback of conventional brushes is the inability to painlessly remove the brush from tangled hair.

Prior art brushes have tried to address the problem of utilizing retractable bristles to address self-styling and tangling concerns with limited success. However, these prior art retractable bristle brushes typically utilize complicated systems of movement that increase the cost of manufacture of the brush, require two hands to operate effectively, fail due to material collected within the operating components of the brush and often do not provide the ability to style hair without creating undue tangling of hair.

One example of a retractable bristle brush is disclosed in U.S. Pat. No. 4,226,251 to Wall. This brush is rectangular shaped preventing effective curling of hair and requires a two-step process of depressing a cantilever and sliding a mechanism to lock the bristles in a retracted position. U.S. Pat. No. 5,815,877 to Heneveld provides a rectangular brush wherein bristles are retracted from the topside of the brush by moving a sleeve that holds the bristles along a bottom side of the brush retracting the bristles into the brush handle.

Several prior art brushes provide a circular bristle sections that require extensive mechanical systems and movement to retract and/or extend the bristles. U.S. Pat. No. 6,070,594 to Mears discloses a circular brush having bristles mounted on rotatable axles, which are then moveably mounted on an inner mandrel with the bristles extending through slots through an outer mandrel rotatably mounted on the brush. The system requires a user to rotate the inner mandrel in relation to the outer mandrel while maintaining the brush in a styling position to retract the bristles.

U.S. Pat. No. 4,596,261 to Renda et al. discloses a complicated system utilizing cams and grooves and includes several control mechanisms to retract and extend the bristles. The brush as disclosed does not provide for single hand use in styling one's hair.

U.S. Pat. No. 4,567,905 to Stewart et al. discloses another version of a cam operated slidable retractable bristle brush. The bristle retraction control operates by co-action with a rotatable cylindrical mandrel having pivotal bristles.

It is thus desired to provide a retractable bristle brush that allows a user to utilize a single hand to retract or extend the bristles from the brush. It is a further desire to provide a retractable bristle brush that reduces the number of moving parts and thus the associated problems with sticking and loss of use of prior art brushes. It is a still further desire to provide an economical retractable bristle brush.

SUMMARY OF THE INVENTION

In view of the foregoing and other considerations, the present invention relates to a retractable bristle brush wherein the bristles may be retracted or extended from the brush by a single movement of a user's hand while grasping the brush handle.

It is a feature of the present invention to provide a retractable bristle brush that is reliable.

It is a further feature of the present invention to provide a retractable bristle brush that can be economically manufactured.

Accordingly, a retractable bristle brush of the type for retracting the bristles into the brush is provided. The retractable bristle brush includes a handle adapted for grasping by a user and an elongated, cylindrical inner mandrel extending from the handle; a plurality of bristles extending outwardly from the inner mandrel; a cylindrical external mandrel is slidably mounted on the inner mandrel, the external mandrel forming a bristle orifice through a top surface thereof in connection with a bristle cavity formed by the external mandrel wherein each associated orifice and bristle cavity disposes at least one bristle; and a mechanism for controlling bristle extension in connection between the external mandrel and the internal mandrel limiting longitudinal movement of the external mandrel between an open position wherein the bristles extend through the orifice and a closed position wherein the bristles are retracted to a position within the bristle cavity proximate the top surface of the external mandrel.

The external mandrel may be constructed as a unitary piece or formed by interconnected vertical mandrel segments or longitudinal segment halves. The bristle cavity is defined by an interior wall that may include a first angled wall section extending from the orifice to the inner mandrel and a second wall section extending substantially perpendicular from the orifice to the inner mandrel.

The retractable bristle brush may include: a handle adapted for grasping by a user; an elongated, cylindrical inner mandrel extending from the handle; a plurality of bristles extending outwardly from the inner mandrel; a cylindrical external mandrel slidably mounted on the inner mandrel, the external mandrel comprising interconnected mandrel segments forming a bristle orifice through a top surface of the external mandrel in connection with a bristle cavity formed by the external mandrel wherein each associated orifice and bristle cavity disposes at least one bristle, the orifice and bristle cavity formed by a first angled wall section extending from the orifice to the inner mandrel by one of the mandrel segments and a second wall section extending substantially perpendicular from the orifice to the inner mandrel formed by an adjacent mandrel segment; and a mechanism for controlling bristle extension in connection between the external mandrel and the internal mandrel limiting longitudinal movement of the external mandrel between an open position wherein the bristles extend through the orifice and a closed position wherein the bristles are retracted to a position within the bristle cavity proximate the top surface of the external mandrel.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
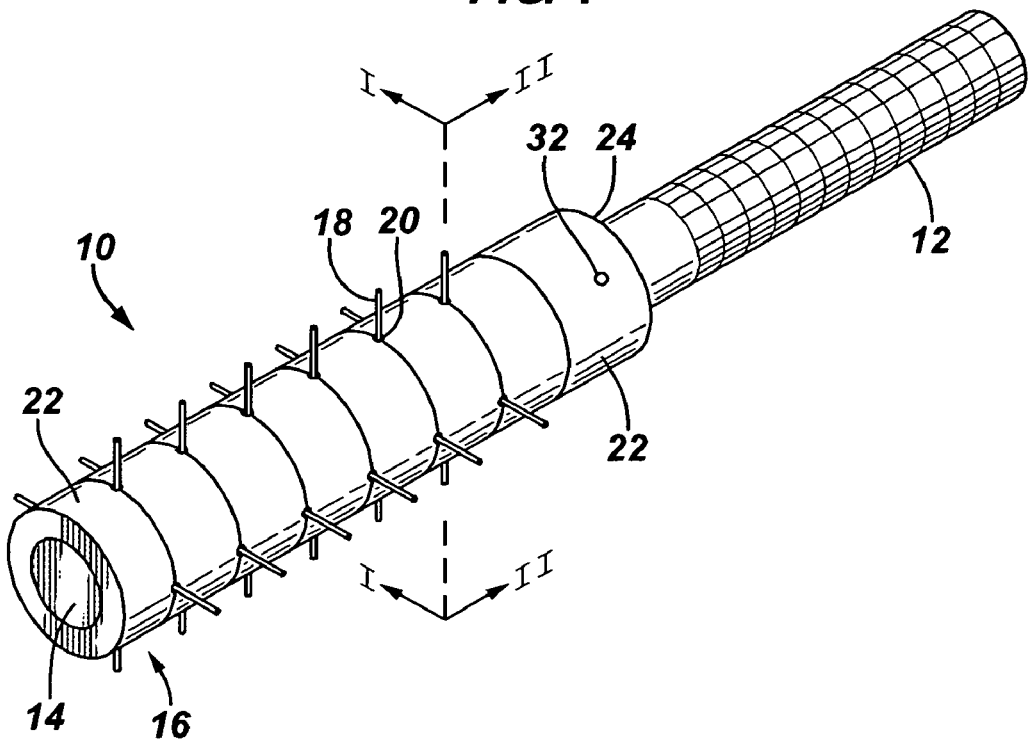
FIG. 1 is a perspective view of the retractable bristle brush of the present invention shown in the open position with the bristles extended.

Refer now to the drawings wherein depicted elements are not necessarily shown to scale and wherein like or similar elements are designated by the same reference numeral through the several views.

FIG. 1 a perspective view of the retractable bristle brush of the present invention, generally designated by the numeral 10, shown in the open position with the bristles extended. Brush 10 includes a handle 12, a substantially cylindrical internal mandrel 14, a substantially cylindrical external mandrel 16, and bristles 18.

As shown, handle 12 and internal mandrel 14 are interconnected to form a substantially longitudinal section, although handle 12 and internal mandrel 14 may be position at an angle from one another. Handle section 12 and internal mandrel 14 may be formed as a unitary piece as a main brush body or formed in separate processes and interconnected. It is desired that handle 12 and mandrel 14 be formed of material that withstands heat such as from a blow dryer and resistant from staining and deterioration from chemicals common in hair styling. Bristles 18 are connected to and extend from internal mandrel 14. Bristles 18 extend outwardly through external mandrel 16 and may be spaced or oriented in various designs to address various textures and other characteristics of fibers.

Figure 2:
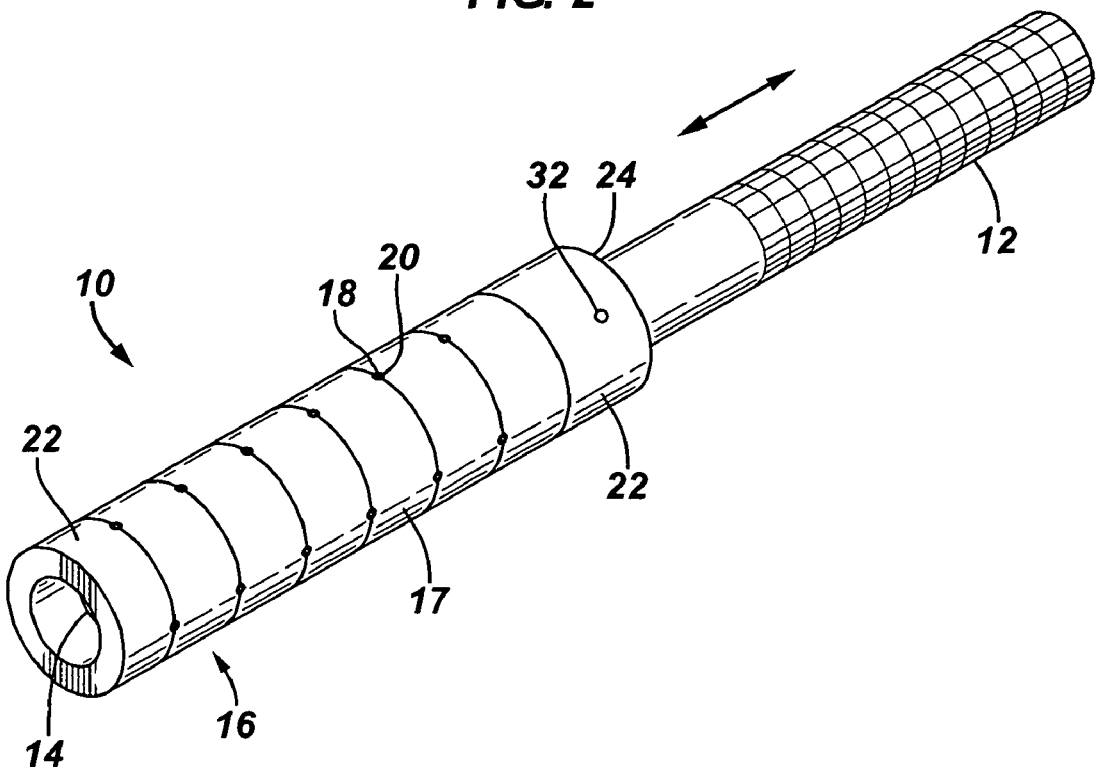
FIG. 2 is a perspective view of the retractable bristle brush of the present invention shown in the closed position with the bristles retracted.
Figure 3:
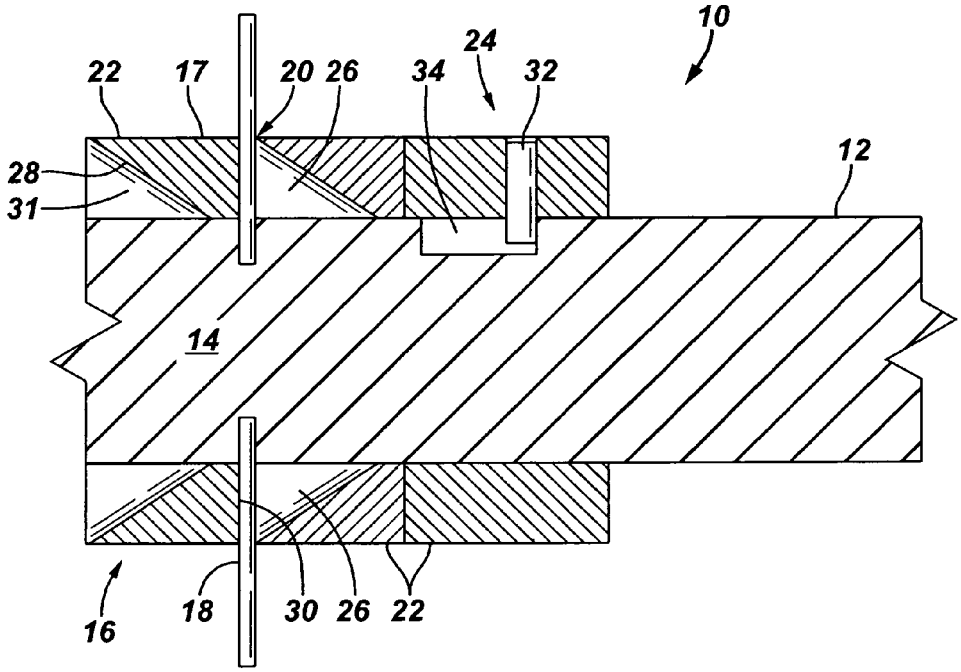
FIG. 3 is a partial cross-sectional view of the retractable bristle brush of the present invention shown along the line I—I of FIG. 1.

External mandrel 16 is a substantially cylindrical member slidably positioned on internal mandrel 14. External mandrel 16 has a plurality of bristle orifices 20 formed therethrough, each of the bristle orifices 20 passing at least one bristle therethrough. As shown in FIGS. 1 through 3, various external mandrel segments 22, each of which is connected to another mandrel segment 22, form external mandrel 16. Utilizing segments 22 to form orifices 20 and external mandrel 16 facilitates ease of production and assembly of brush 10. However, it should be recognized that external mandrel 16 may be formed by longitudinal or horizontal segment halves or as a unitary piece.

Brush 10 further includes a bristle control mechanism 24 that limits movement of external mandrel 16 relative to handle 12 from an open position wherein bristles 18 extend exterior of external mandrel 16 (FIG. 1) to a closed position wherein bristles 18 are retracted through orifices 20 and below or proximate a top surface 17 of external mandrel 16. Bristle control mechanism 24 is further described in relation to FIG. 3.

FIG. 2 is a perspective view of retractable bristle brush 10 of the present invention shown in the closed position with bristles 18 retracted. As shown in FIG. 2, a user has moved external mandrel 16 outwardly along inner mandrel 14 so that bristles 18 are retracted into orifices 20 and positioned proximate top surface 17 of external mandrel 16. In varying embodiments external mandrel 16 may be moved outwardly along internal mandrel 14 or toward handle 12 to retract bristles 18 as will be better understood in relation to FIG. 3.

FIG. 3 is a partial cross-sectional view of retractable bristle brush 10 of the present invention shown along the line I—I of in FIG. 1. As shown, handle 12 and inner mandrel 14 are constructed as a unitary, elongated member having a substantially constant diameter. The demarcation of inner mandrel 14 and handle 12 being the positioning of external mandrel 16 over inner mandrel 14 and the location of bristles 18. Inner mandrel 14 and handle 12 may have different cross-sections.

A plurality of bristles 18 are connected to inner mandrel 14. Bristles 18 may be arranged in various configurations to address general and specific uses for brush 10.

As shown, in FIGS. 1 through 3, external mandrel 16 is constructed of a plurality of external mandrel segments 22 that are interconnected. Segments 22 can be interconnected in various manners such as, but not limited to, cementing. Orifices 20 are formed by the interconnection of segments 22. The interconnection of segments 22 further form a bristle cavity 26 in connection with orifice 20. As demonstrated in FIG. 3, an orifice 20 is formed through top surface 17 of external mandrel 16 to pass a bristle 18. An interior wall 31 having a first angled wall section 28 and a second wall section 30 define a bristle cavity 26. First angled wall section 28 is formed within external mandrel 16 at an angle from orifice 20 to inner mandrel 14. Each angled wall section 28 is oriented in the same direction as the other bristle cavity 26 angled wall sections 28 in a manner such that moving mandrel 16 from the open to the closed position such that bristle 18 is retracted into bristle cavity 26. Second wall section 30 extends from orifice 20 to inner mandrel 14 and forms an indent for placement of bristle 18. Second wall section 30 is substantially perpendicular top surface 17, but may be angled to facilitate movement of bristle 18 into and out of orifice 20. When external mandrel 16 is constructed utilizing segments 22 adjacent segments form orifice 20 and first angled wall section 28 and second wall section 30. In the open position, bristle 18 is positioned proximate second wall section 30 extending through orifice 20. Second wall section 30 provides physical support and strength to bristle 18 when being utilized. When brush 10 is in the closed position, bristle 18 is positioned proximate first angled wall section 28 with bristle 18 substantially retracted into bristle cavity 26.

Mandrel 16 further includes bristle control mechanism 24 to facilitate movement of mandrel 16 between the open and closed position. In FIG. 3 control mechanism 24 is shown as part of a separate mandrel segment 22, however, it should be recognized that it may be part of a segment 22 also forming a bristle cavity 26 or part of a unitary external mandrel 16.

Control mechanism 24 limits the movement of mandrel 16 between a fully open position wherein bristle 18 extends out of orifice 20 to a fully closed position wherein bristle 18 is retracted to a position proximate top surface 17. In a preferred embodiment, control mechanism 24 includes a stop 32, such as a pin, extending through outer mandrel 16 into a slot formed by inner mandrel 14. As shown, slot 34 is an opening formed longitudinally along inner mandrel 14 and has a length proximate the length of the portion of bristle 18 that extends above top surface 17 when brush 10 is in the fully open position. Control mechanism 24 limits longitudinal movement of external mandrel 16 between the fully open and fully closed position and restricts axial movement of external mandrel 16 in relation to inner mandrel 14 and handle 12. Further it is desired that external mandrel 16 extend beyond the ends of slot 34 to prevent collection of debris therein and pinching of a user.

Although external mandrel 16 is shown as formed by vertical segments 22 it may be formed by horizontal segment halves or as a unitary section. Utilization of segments 22 facilitates ease of construction and tighter tolerance of bristle 18 in orifice 20 reducing debris and contaminant entrance into bristle cavity 26.

Figure 4:
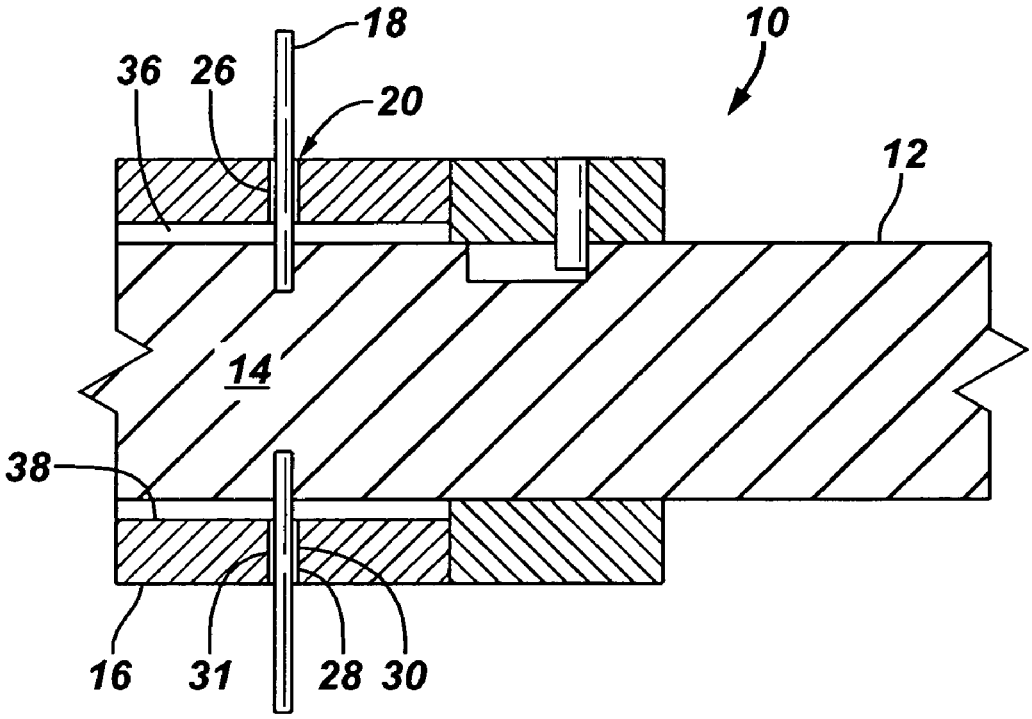
FIG. 4 is a partial cross-sectional view of another embodiment of the retractable bristle brush of the present invention shown along the line I—I of FIG. 1.

FIG. 4 is a cross-sectional view of another embodiment of external mandrel 16 of the present invention. The embodiment of FIG. 4 primarily features a bristle channel 36 formed along a bottom surface 38 of external mandrel 16 proximate inner mandrel 14. Each channel 36 extends substantially longitudinally from bristle cavity 20. When brush 10 is in the closed position a portion of bristle 18 may be disposed therein. Channel 36 facilitates movement of external mandrel 16 between the open and closed position, reduces wear on bristles 18 and provides a stiffer connection between inner mandrel 14 and external mandrel 16.

FIG. 4 additionally illustrates another embodiment of bristle cavity 20. In this embodiment, bristle cavity 20 is defined by an interior wall 31 and extends substantially parallel to an extended bristle 18. It should be recognized that this is only one possible configuration of bristle cavity 20.

Figure 5:
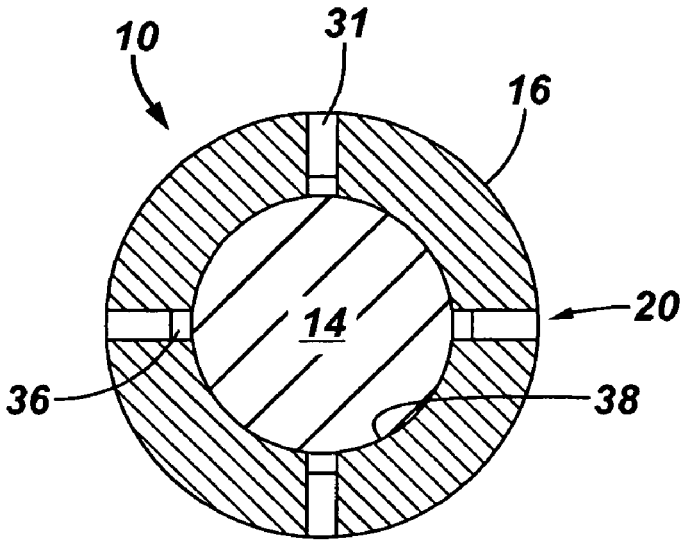
FIG. 5 is a cross-section view of the retractable bristle brush of the present invention shown along the line II—II of FIG. 1.

FIG. 5 is a cross-sectional view of brush 10 along the line II—II of FIG. 1 of the present invention with bristles 18 removed. This figure illustrates external mandrel 16 utilizing channel 36. A portion of external mandrel 16 is cut out along the inner surface 38 proximate bristle cavity 20 to define a channel for disposing bristle 18. Channel 36 may have tapered walls to match the external shape of bristles 18. Bristle cavity 20 is defined by wall 31 that may have a tapered wall section such as shown in FIG. 3.

An example of a manner of use of retractable brush 10 of the present invention is described with reference to FIGS. 1 through 3. Brush 10 is constructed with a handle 12 adapted for gripping by a user and having an elongated, cylindrical inner mandrel 14 having a plurality of bristles 18 extending substantially therefrom. An external mandrel 16 is constructed having orifices 20 and associated bristle cavities 26 formed so that each orifice 20 and cavity 26 aligns with and disposes a bristle 18. External mandrel 16 is slidably disposed on external mandrel 14 so that at least one bristle 18 is disposed in each bristle cavity 26. A stop 32 is disposed through external mandrel 16 into slot 34 of inner mandrel 14 so that external mandrel 16 may be moved from a fully open position in which bristles 18 extend from orifices 20 to a closed position in which bristles 18 are retracted into bristle cavity 26 and proximate top surface 17.

In the open position brush 10 may be used as a conventional brush for grooming and styling hair. When a hair becomes tangled or hair is styled about brush 10, external mandrel 16 can be moved to the closed position retracting bristles 18 into cavity 26 and brush 10 can easily be removed from the hair without disrupting the style formed or excessive pulling of hair. Additionally, brush 10 may be maintained in the closed position to facilitate storage and reduce collection of dirt and debris in bristles 18.

From the foregoing detailed description of specific embodiments of the invention, it should be apparent that a retractable bristle brush has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A retractable bristle brush comprising:

a handle adapted for grasping by a user;

an elongated, cylindrical inner mandrel extending from said handle;

a plurality of bristles extending outwardly from said inner mandrel;

a cylindrical external mandrel slidably mounted on said inner mandrel, said external mandrel forming at least one bristle orifice through a top surface thereof in connection with a bristle cavity formed by said external mandrel wherein each said orifice and said bristle cavity disposes at least one said bristle; and a means for controlling bristle extension in connection between said external mandrel and said internal mandrel limiting longitudinal movement of said external mandrel between an open position wherein said bristles extend though said orifice and a closed position wherein said bristles are retracted to a position within said bristle cavity proximate said top surface of said external mandrel:

wherein said bristle cavity is defined by a first angled wall section extending from said orifice to said inner mandrel and a second wall section extending substantially perpendicular from said orifice to said inner mandrel.

2. The retractable bristle brush of claim 1 wherein said external mandrel is constructed as a unitary piece.

3. The retractable bristle brush of claim 2 wherein said bristle cavity is defined by a first angled wall section extending from said orifice to said inner mandrel by one said mandrel segment and a second wall section extending substantially perpendicular from said orifice to said inner mandrel formed by an adjacent said mandrel segment.

4. The retractable bristle brush of claim 3 wherein said bristle control means includes a stop extending from said external mandrel into a longitudinal slot formed by said inner mandrel.

5. The retractable bristle brush of claim 2 wherein said bristle control means includes a stop extending from said external mandrel into a longitudinal slot formed by said inner mandrel.

6. The retractable bristle brush of claim 1 wherein said external mandrel is constructed of interconnected mandrel segments.

7. The retractable bristle brush of claim 6 wherein said bristle cavity is defined by a first angled wall section extending from said orifice to said inner mandrel and a second wall section extending substantially perpendicular from said orifice to said inner mandrel.

8. The retractable bristle brush of claim 7 wherein said bristle control means includes a stop extending from said external mandrel into a longitudinal slot formed by said inner mandrel.

9. The retractable bristle brush of claim 7 further including a channel formed through an inner surface of said external mandrel proximate each bristle cavity adapted for disposing said bristle.

10. The retractable bristle brush of claim 6 wherein said bristle control means includes a stop extending from said external mandrel into a longitudinal slot formed by said inner mandrel.

11. The retractable bristle brush of claim 1 wherein said bristle control means includes a stop extending from said external mandrel into a longitudinal slot formed by said inner mandrel.

12. The retractable bristle brush of claim 1 further including a channel formed through an inner surface of said external mandrel proximate each bristle cavity adapted for disposing said bristle.

13. A retractable bristle brush comprising:

a handle adapted for grasping by a user;

an elongated, cylindrical inner mandrel extending from said handle;

a plurality of bristles extending outwardly from said inner mandrel;

a cylindrical external mandrel slidably mounted on said inner mandrel, said external mandrel comprising interconnected mandrel segments forming at least one bristle orifice through a top surface of said external mandrel in connection with a bristle cavity formed by said external mandrel wherein each said orifice and said bristle cavity disposes at least one said bristle, said orifice and said bristle cavity formed by a first angled wall section extending from said orifice to said inner mandrel by one said mandrel segment and a second wall section extending substantially perpendicular from said orifice to said inner mandrel formed by an adjacent said mandrel segment; and a means for controlling bristle extension in connection between said external mandrel and said internal mandrel limiting longitudinal movement of said external mandrel between an open position wherein said bristles extend through said orifice and a closed position wherein said bristles are retracted to a position within said bristle cavity proximate said top surface of said external mandrel.

14. The retractable bristle brush of claim 13 wherein said bristle control means includes a stop extending from said external mandrel into a longitudinal slot formed by said inner mandrel.

15. The retractable bristle brush of claim 13 further including a channel formed through an inner surface of said external mandrel proximate each bristle cavity adapted for disposing said bristle.

16. The retractable bristle brush of claim 15 wherein said bristle control means includes a stop extending from said external mandrel into a longitudinal slot formed by said inner mandrel.

* * * * *